US006832613B2

(12) United States Patent
Brunbauer

(10) Patent No.: US 6,832,613 B2
(45) Date of Patent: Dec. 21, 2004

(54) FILTER CIGARETTE

(75) Inventor: Ernst Brunbauer, Traun (AT)

(73) Assignee: Trierenberg Holding Aktiengesellschaft, Traun (AT)

( * ) Notice: Subject to any disclaimer, the term of this patent is extended or adjusted under 35 U.S.C. 154(b) by 0 days.

(21) Appl. No.: 10/203,833

(22) PCT Filed: Jan. 30, 2001

(86) PCT No.: PCT/AT01/00022

§ 371 (c)(1),
(2), (4) Date: Oct. 11, 2002

(87) PCT Pub. No.: WO01/58289

PCT Pub. Date: Aug. 16, 2001

(65) Prior Publication Data

US 2003/0056802 A1 Mar. 27, 2003

(30) Foreign Application Priority Data

Feb. 14, 2000 (AT) ..... A219/2000

(51) Int. Cl.[7] ..... A24D 3/04

(52) U.S. Cl. ..... 131/339; 131/336; 131/341; 131/360; 131/361; 131/331; 131/365

(58) Field of Search ..... 131/361, 365, 131/331, 360, 334; 162/139

(56) References Cited

U.S. PATENT DOCUMENTS

| | | | | |
|---|---|---|---|---|
| 2,976,190 A | | 3/1961 | Meyer | |
| 3,586,005 A | | 6/1971 | Lippman | |
| 3,744,497 A | | 7/1973 | Marciuliano | |
| 4,587,982 A | | 5/1986 | Adams et al. | |
| 4,630,620 A | | 12/1986 | Gabriel | |
| 4,651,756 A | * | 3/1987 | Luke et al. | 131/95 |
| 5,902,501 A | * | 5/1999 | Nunnally et al. | 219/263 |

FOREIGN PATENT DOCUMENTS

| | | |
|---|---|---|
| BE | 573 023 A | 5/1959 |
| CH | 343 865 A | 2/1960 |
| DE | 1 885 864 U | 4/1962 |
| DE | 30 38 093 A1 | 5/1982 |
| DE | 31 47 531 A1 | 7/1982 |
| DE | 34 05 221 A1 | 8/1985 |
| DE | 34 45 354 A1 | 8/1985 |
| DE | 36 01 959 A1 | 8/1986 |
| GB | 2 184 339 A | 6/1987 |
| WO | 89/03183 A1 | 4/1989 |

* cited by examiner

*Primary Examiner*—Dionne A. Walls
(74) *Attorney, Agent, or Firm*—Wenderoth, Lind & Ponack, L.L.P.

(57) ABSTRACT

A cigarette filter is surrounded by a wrapping paper, and the wrapping paper includes metal only on portion of a surface thereof, such that air can penetrate through the wrapping paper into the filter.

18 Claims, 2 Drawing Sheets

FILTER CIGARETTE

BACKGROUND OF THE INVENTION

The invention concerns a filter cigarette whose filter is surrounded by a filter wrapping paper which is enclosed by a tip layer, wherein an interior of the filter wrapping paper is coated with metal, in particular aluminum.

Development of cigarettes with reduced smoke constituents, in particular nicotine, condensate and carbon monoxide, has globally been driven forward by statutory regulations, a higher level of consumer acceptance and increased awareness of health.

Usually, cigarette papers which are highly permeable to air and burning-friendly are used for production of cigarettes with reduced smoke constituents, and a cigarette filter has been additionally vented by a perforated zone in a tip layer. Both technical measures dilute a main smoke flow by virtue of secondary air, and thereby reduce a level of concentration of smoke constituents. Use of filter material with a high retention action and a high draw resistance also causes a reduction in smoke constituents, but encounters limitations in terms of acceptance by consumers.

In the state of the art, DE 3038093 A1, WO 89/03183 A1 and CH 343865 disclose cigarette filters in which metal is introduced into the filter. That, however, on the one hand involves a considerable increase in expenditure in manufacture of filters, while on the other hand an effect achieved thereby is only very vaguely described with regard to its effect.

SUMMARY OF THE INVENTION

Therefore, a basic starting point adopted by the invention is a filter cigarette whose filter is surrounded by a filter wrapping paper which is enclosed by a tip layer, wherein air can penetrate into the filter through the filter wrapping paper. In accordance with the invention a coating is applied only on a part of the filter wrapping paper so that air can penetrate through the wrapping paper into the filter.

A metalization effect can be implemented by application in particle form, and/or by suitable application of flat patterns, to the wrapping paper on a surface of the paper, but not by complete coating of the filter wrapping paper. Surprisingly, partial coating of the filter wrapping paper with metal causes a selective reduction in carbon monoxide content of a main smoke flow.

Further features and details of the present invention will be apparent from its specific description hereinafter.

DETAILED DESCRIPTION OF THE PREFERRED EMBODIMENTS

Figure 1:
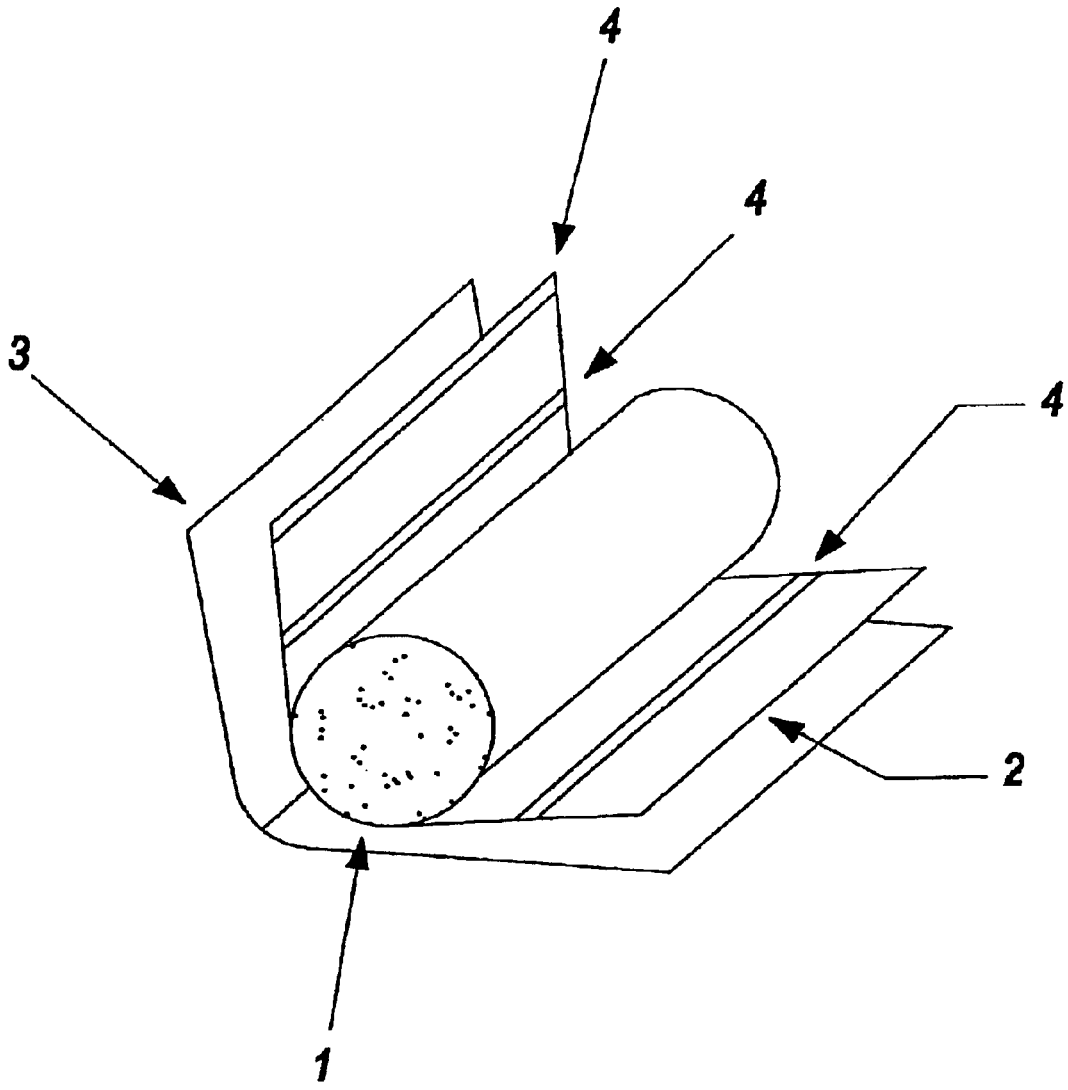
FIG. 1 shows a filter wrapping paper according to the invention with aluminum strips.

In FIG. 1, aluminum strips have been applied to a commercially available highly porous paper for wrapping cigarette filters (Papierfabrik Wattens GmbH, QNo 27400), with an air permeability of 6000 CU, by performing a hot foil process. A width of the porous paper was 26.5 mm and a width of each aluminum strip was 1 mm. A spacing between the strips was 1 mm. Filter rods for cigarettes were produced in a per se known manner from a usual industrial acetate cable measuring about 1000 m in length. FIG. 1 shows a structure of such a filter rod comprising acetate cable 1, wrapping paper 2 and tip layer 3, while reference 4 denotes the aluminum strips according to the invention.

Cigarettes are produced by machine, using these filter rods. For comparison purposes, cigarettes were produced on a basis of the same composition in terms of filter, cigarette paper and tobacco blend, but without previous zone-wise coating of a filter wrapping paper. The cigarettes produced were smoked under standardized conditions in a smoking laboratory. With regard to cigarettes of the invention, smoke constituents of a main smoke flow had a selectively and significantly lower carbon monoxide content, as shown in Table 1.

TABLE 1

Results of standardized smoking of cigarettes with (modified) and without (standard) aluminum strips 4 on the filter wrapping paper 2.

| | Draw number | Nicotine (mg/cig) | Nicotine-free dry condensate (mg/cig) | CO (mg/cig) |
|---|---|---|---|---|
| Modified filter wrapping paper | 8.42 (8.44) | 0.61 (0.64) | 8.37 (8.31) | 9.04 (8.58) |
| Standard filter wrapping paper | 8.12 (8.24) | 0.63 (0.64) | 9.06 (9.08) | 11.86 (10.96) |

The parenthesis show results of a second independent measurement series.

ÖZF: Österreichische Zigarettenfilter GmbH, Hainburg/Donau

Figure 2:
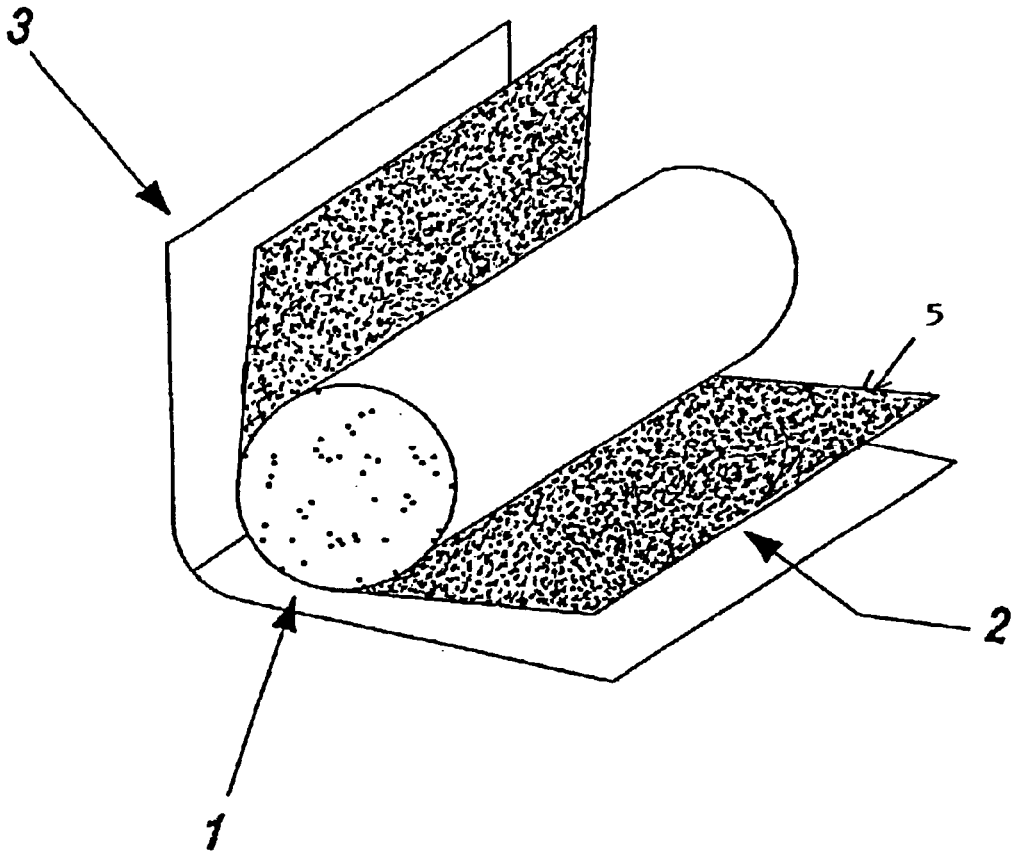
FIG. 2 shows a filter wrapping paper according to the invention with a finely distributed and highly porous aluminum layer.

FIG. 2 shows another embodiment according to the invention. Here, with a structure of the filter rod otherwise being the same with regard to acetate cable 1 and tip layer 3, filter wrapping paper 2 was coated with aluminum in a finely distributed form, but here aluminum layer 5 was highly porous. This kind of aluminum coating ensures that air permeability of the filter wrapping paper is sufficiently maintained so that, as also with the embodiment of FIG. 1, sufficient air can pass laterally into the cigarette filter.

For comparison purposes and to demonstrate action of the highly porous aluminum layer 5, besides the embodiment according to the invention as shown in FIG. 2, otherwise identical cigarette filters were produced without aluminum coating 5 on wrapping paper 2. These filter rods were used to produce, by machine, otherwise equivalent cigarettes with and without the coating 5. The cigarettes produced therefore differ only with regard to presence of the coating 5. The cigarettes produced in that way, as in the case of the embodiment of FIG. 1, were also smoked under standardized conditions in a smoking laboratory. Measured smoke constituents of a main smoke flow of cigarettes of this embodiment also have a selectively and significantly lower carbon monoxide content, and therefore, have a similar effect as with the first embodiment. Table 2 shows results of measurement of the same parameters as in Table 1, but in a comparison between cigarettes with a standard filter wrapping paper, and cigarettes with filter wrapping paper 2 according to the second embodiment of the invention, which is coated with a finely distributed highly porous aluminum layer 5.

TABLE 2

Results of standardized smoking of cigarettes with (modified) and without (standard) finely distributed highly porous aluminum coating 5 on the filter wrapping paper 2.

| | Draw number | Nicotine (mg/cig) | Nicotine-free dry condensate (mg/cig) | CO (mg/cig) |
|---|---|---|---|---|
| Modified filter wrapping paper | 7.71 | 0.43 | 7.67 | 11.33 |
| Standard filter wrapping paper | 7.99 | 0.46 | 7.62 | 14.26 |

Clearly, the invention combines a known advantage of filter venting with an effect which is to be attributed to a metal coating. In this respect, the two embodiments show that an effect can be demonstrated, irrespective of a nature of the metal coating, as long as combination of air permeability of filter wrapping paper and metal coating of the filter wrapping paper is guaranteed. This makes it clear that the invention is not limited to the illustrated embodiments, but includes all possible combinations of the embodiments shown herein and other embodiments in accordance with combining a porous filter wrapping paper and a metal coating.

A physical or chemical mechanism to which this effect is to be attributed still remains to be investigated. A possible explanation would be adsorption of carbon monoxide by the metal coating, whereas a purely catalytic action, because of a low temperature in the filter, is improbable.

What is claimed is:

1. A cigarette including a filter, wherein:

said filter is surrounded by a wrapping paper;

said wrapping paper includes metal only on portion of a surface thereof, such that air can penetrate through said wrapping paper into said filter; and said wrapping paper is surrounded by a tip layer.

2. The cigarette according to claim 1, wherein said metal is on a surface of said wrapping paper that faces said filter.

3. The cigarette according to claim 2, wherein said metal comprises aluminum.

4. The cigarette according to claim 3, wherein said metal comprises longitudinally extending strips.

5. The cigarette according to claim 4, wherein said metal is finely distributed on said wrapping paper in a highly porous form.

6. The cigarette according to claim 3, wherein said metal is finely distributed on said wrapping paper in a highly porous form.

7. The cigarette according to claim 2, wherein said metal comprises longitudinally extending strips.

8. The cigarette according to claim 7, wherein said metal is finely distributed on said wrapping paper in a highly porous form.

9. The cigarette according to claim 2, wherein said metal is finely distributed on said wrapping paper in a highly porous form.

10. A cigarette filter, wherein:

said filter is surrounded by a wrapping paper;

said wrapping paper includes metal only on portion of a surface thereof, such that air can penetrate through said wrapping paper into said filter; and said wrapping paper is surrounded by a tip layer.

11. The cigarette filter according to claim 10, wherein said metal is on a surface of said wrapping paper that faces said filter.

12. The cigarette filter according to claim 11, wherein said metal comprises aluminum.

13. The cigarette filter according to claim 12, wherein said metal comprises longitudinally extending strips.

14. The cigarette filter according to claim 13, wherein said metal is finely distributed on said wrapping paper in a highly porous form.

15. The cigarette filter according to claim 12, wherein said metal is finely distributed on said wrapping paper in a highly porous form.

16. The cigarette filter according to claim 11, wherein said metal comprises longitudinally extending strips.

17. The cigarette filter according to claim 16, wherein said metal is finely distributed on said wrapping paper in a highly porous form.

18. The cigarette filter according to claim 11, wherein said metal is finely distributed on said wrapping paper in a highly porous form.

* * * * *